US006466181B1

(12) United States Patent
Ho et al.

(10) Patent No.: US 6,466,181 B1
(45) Date of Patent: Oct. 15, 2002

(54) MULTI-SATELLITE ANTENNA MAST ALIGNMENT SYSTEM

(75) Inventors: Kesse Ho, Westminster, CA (US); Frank C. Accardo, Torrance, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/893,268

(22) Filed: Jun. 27, 2001

(51) Int. Cl.[7] ..... H01Q 3/02; H01Q 3/00
(52) U.S. Cl. ..... 343/882; 343/765; 343/880
(58) Field of Search ..... 343/878, 880, 343/881, 882, 890, 915, DIG. 2, 840, 889, 765

(56) References Cited

U.S. PATENT DOCUMENTS

| | | | | | |
|---|---|---|---|---|---|
| 4,628,323 | A | * | 12/1986 | Crean | 343/765 |
| 5,526,010 | A | | 6/1996 | Plunk | 343/882 |
| 5,644,320 | A | * | 7/1997 | Rossi | 343/702 |
| 5,870,059 | A | * | 2/1999 | Reynolds | 343/760 |
| 5,941,497 | A | | 8/1999 | Inoue et al. | 248/514 |
| D413,603 | S | | 9/1999 | Inoue | D14/231 |
| 6,031,508 | A | | 2/2000 | Ishizuka et al. | 343/882 |
| 6,037,913 | A | * | 3/2000 | Johnson | 343/882 |
| 6,211,845 | B1 | | 4/2001 | Cook et al. | 343/882 |
| 6,236,376 | B1 | | 5/2001 | Ors | 343/882 |

* cited by examiner

*Primary Examiner*—Hoang Nguyen
(74) *Attorney, Agent, or Firm*—John A. Crook; Michael W. Sales

(57) ABSTRACT

An antenna mast for a multi-satellite system includes a base mounted at a lower end of the mast. The base is intended to be mounted to a surface. The antenna mast has a first adjustment mechanism that allows the mast to be adjusted in a y-direction. The antenna mast also has a second adjustment mechanism that allows the mast to be adjusted in an x-direction such that the uppermost portion of the antenna mast is straight.

20 Claims, 2 Drawing Sheets

MULTI-SATELLITE ANTENNA MAST ALIGNMENT SYSTEM

TECHNICAL FIELD

The present invention relates generally to a multi-satellite mast alignment system, and more particularly, to an antenna mast that allows for more flexibility during installation.

BACKGROUND ART

Single-satellite systems, such as an 18" system, are well known. In these single satellite systems, an antenna mast is attached to a base, which in turn is secured to a surface such that the antenna is firmly mounted. An antenna dish is located opposite the base and communicates with the satellite. In these single satellite systems, it is not necessary that the antenna mast be perfectly straight, i.e., perpendicular to the ground. These antenna masts may instead be somewhat crooked or not too perpendicular to the ground and still function properly. Any alignment errors due to a crooked or non-perpendicular antenna mast can be compensated by adjusting the elevation and azimuth of the antenna mast slightly different from the recommended value.

More recently, multi-satellite antenna systems have been developed that require that the antenna be capable of three degrees of adjustments, namely, tilt, elevation, and azimuth. The ability to adjust tilt is now required because the antenna dish must be lined up with the satellite belt when two or more satellites are utilized. In order to acquire the signals easily with all three degrees of freedom, the recommended settings must be observed. The antenna mounting mast must be perfectly straight up with respect to ground (earth). If the antenna mast is not perfectly straight, the three settings will be incorrect and a user will not know which dimension to adjust since there are now four dimensional freedoms (mast, elevation, tilt, and azimuth) and only one combination is correct. With these multi-satellite systems, the user cannot merely adjust the elevation to compensate for the error, because this would render the tilt calibration table useless. Moreover, with this type of adjustment, there is no way to assure that the antenna is correctly aligned with the satellites. Thus, in order to maximize the ability to locate the maximum signal quickly for all satellites in the system, the antenna mast must be perfectly straight.

However, current antenna masts can only be adjusted in the y-direction (up/down). Thus, in order for the mast to be perfectly straight as is required, the time consuming labor intensive task of mounting and remounting the mast base must be undertaken. Even for a professional installer, plumbing the antenna mast such that it is perfectly straight can take thirty (30) minutes or more. For a first time installer, such as a home owner, achieving the same result can take up to several hours. Because of this difficulty, many home owners may simply give up trying to plum the antenna mast after repeated attempts and live with less than optimal installation.

An example of a current antenna mast that can only be adjusted in the y-direction is shown in FIG. 1. The antenna mast 10 is preferably comprised of a unitary circular tube 12 having an upper end 14 and a lower end 16. The lower end 16 is securely attached to a base portion 18 by a pivoting mechanism, such as a nut or other conventional securing means 20. The circular tube 12 can move with respect to the base portion 18 by way of an adjustment mechanism 22. The adjustment mechanism 22 in these known existing antenna masts consists of a slide mechanism 24, such as a nut, that is passed through a channel 26 formed in the base portion 18. The channel 26 allows the slide mechanism 24 to slide therealong allowing for a y-direction adjustment of the circular tube 12 for upper mast perpendicularity with respect to earth. By movement of the slide mechanism 24 within the channel 26, the antenna mast 10 can be aligned in the up/down direction (y-direction).

SUMMARY OF THE INVENTION

It is therefore an object of the present invention to provide an antenna mast for a multi-satellite system that is adjustable in multiple directions.

It is a further object of the present invention to provide an antenna mast that can be easily installed as compared to prior antenna masts.

It is another object of the present invention to provide an antenna mast that requires significantly less installation time.

In accordance with the above and the other objects of the present invention, an antenna mast for a multi-satellite system is provided. The antenna mast has a base mounted at a lower end of the mast. The base in turn is intended to be mounted to a surface. The antenna mast has a first adjustment mechanism that allows the mast to be adjusted in a y-direction. The antenna mast also has a second adjustment mechanism that allows the mast to be adjusted in an x-direction, such that the uppermost portion of the antenna mast is straight.

These and other objects, features and advantages of the present invention will become apparent from the following description of the invention, when viewed in accordance with the accompanying drawings and appended claims.

DETAILED DESCRIPTION OF THE EMBODIMENT

Figure 1:
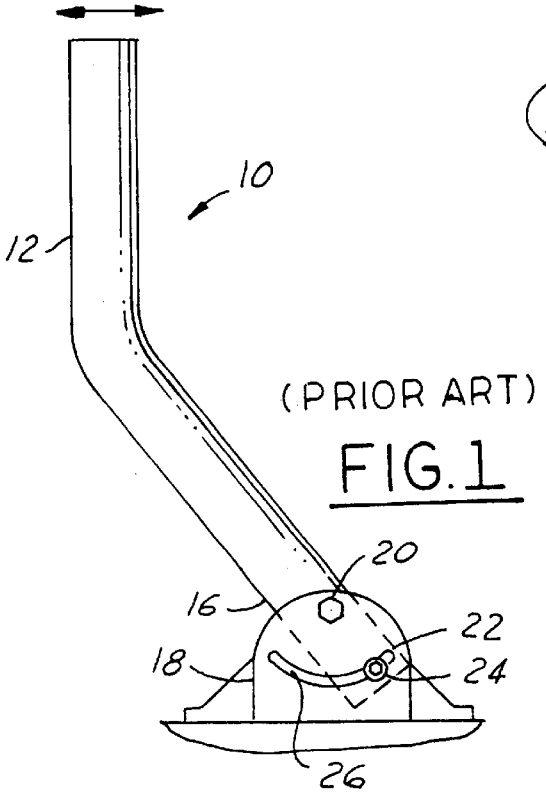
(PRIOR ART) FIG. 1
FIG. 1 is a side view of a prior art antenna mast.
Figure 2:
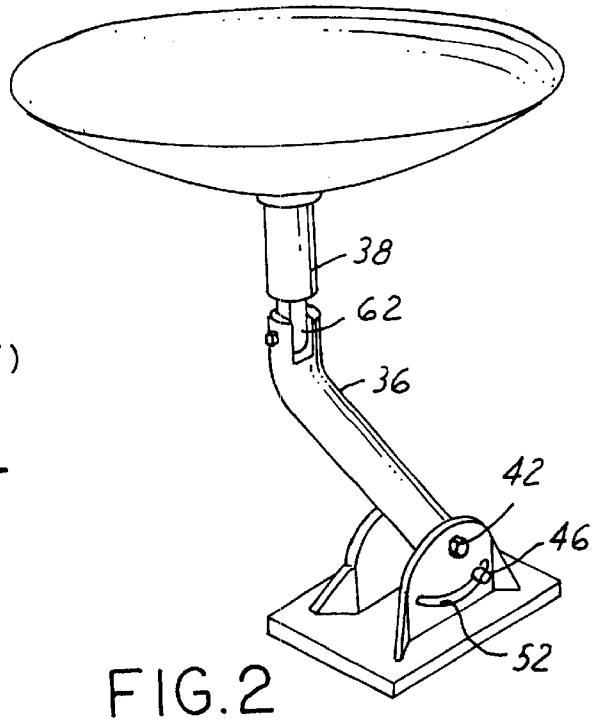
FIG. 2 is a perspective view of an antenna mast and attached satellite antenna in accordance with a preferred embodiment of the present invention.
Figure 3:
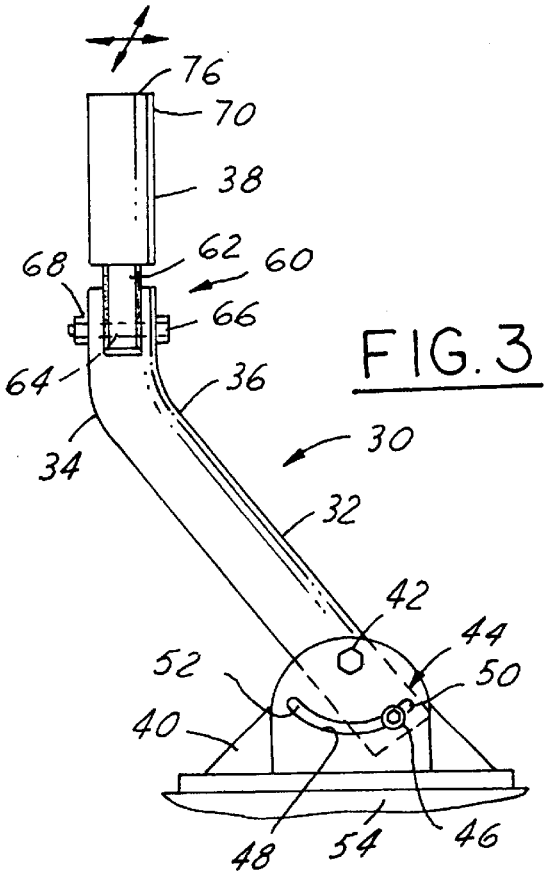
FIG. 3 is a side view of an antenna mast in accordance with a preferred embodiment of the present invention.
Figure 4:
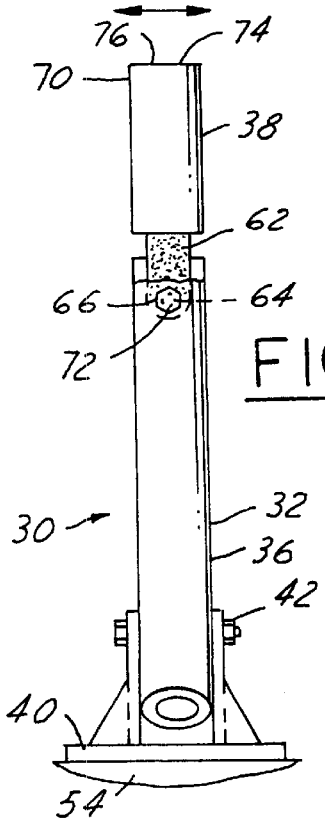
FIG. 4 is a rear view of an antenna mast in accordance with a preferred embodiment of the present invention.

Referring now to FIGS. 2 through 4, which illustrate an antenna mast 30 in accordance with the present invention. The antenna mast 30 is preferably comprised of a generally circular tube 32 having a bend 34 formed therein. While the tube is preferably circular, it should be understood that a variety of other shapes may be utilized. Additionally, the tube is preferably hollow and formed of a metal material. However, it would be understood by one of skill in the art that a variety of other materials and tube configurations can be utilized. The antenna mast 30 is preferably for use with an antenna dish, however, it may be used in a variety of other applications. Moreover, the disclosed antenna mast is preferably utilized as part of a multi-satellite system. Alternatively, such an antenna mast can also be used in all other dish antenna pointing systems, such as 18", USAT, one-way, and two-way systems.

The antenna mast 30 is preferably segregated into a lower portion 36 and a upper portion 38 which is secured to the lower portion 36, as is discussed in more detail below. The lower portion 36 of the antenna mast 30 is attached to a base portion 40 by a pivoting fixation device 42, around a bolt, screw or the like. The base portion 40 also includes a first adjustment mechanism 44 formed therein that allows for adjustment of the antenna mast 30 in one direction. The base portion 40 preferably has a friction surface 54 on its underside thereof to prevent the base portion 40 and thus the mast 30 from moving due to slippage, such as from wind, once it has been installed.

The first adjustment mechanism 44, includes a travel mechanism 46, such as a bolt, a screw, or the like, and a recessed channel 48 formed in the base portion 40, through which the travel mechanism 46 passes. The travel mechanism 46 together with the pivoting fixation device 42 rotatably secures the lower portion 36 of the mast 30 to the base portion 40. The first adjustment mechanism 44 allows the antenna mast 30 to move with respect to the base portion 40 allowing for adjustment of the perpendicularity of the antenna mast 30. This adjustment is accomplished by the movement or sliding of the travel mechanism 46 within the recessed channel 48 between a first end 50 and a second end 52.

The antenna mast 30 also includes a second adjustment mechanism 60 that is located at the connection between the lower portion 36 and the upper portion 38. The upper portion 38 preferably has a generally rectangular flange portion 62 that extends generally downwardly into and is telescopically received within the lower portion 36. While the flange portion 62 is preferably rectangular, it can take on a variety of other shapes, which may depend upon, the shape of the tube 32. In the preferred embodiment, the flange portion 62 has an opening 64 formed therethrough allowing for insertion of a rotatable securing device 66, such as a bolt, screw or the like. The rotatable securing device 66 also passes through a corresponding opening 68 formed in the lower portion 36 to secure the upper portion 38 to the lower portion 36. An antenna dish 54 is secured to the upper portion 38 of the mast 30.

Once secured, the upper portion 38 can be turned about the rotatable securing device 66 in order to adjust the side-to-side or x-direction of the antenna mast 30 such that the uppermost portion 70 of the antenna mast 30 is perfectly straight with respect to the ground. The outer surface of the flange portion 62, is preferably covered with a friction material 72, such as gritty or course paper. The friction material 72 prevents relative movement of the upper portion 38 with respect to the lower portion 36 once the side-to-side adjustment of the upper portion 38 has been completed. Additionally, a bubble level 74 can be integrally formed into the top surface 76 of the antenna mast 30. The bubble level will allow a servicemen or user to simply examine the level and determine whether the uppermost portion 70 of the mast is straight. Therefore, if replumbing is needed, it can be done without removing the antenna dish assembly from the mast 30. Alternatively, if the bubble level indicates that replumbing is not needed, it can easily determined that any problem is due to other factors.

Figure 5:
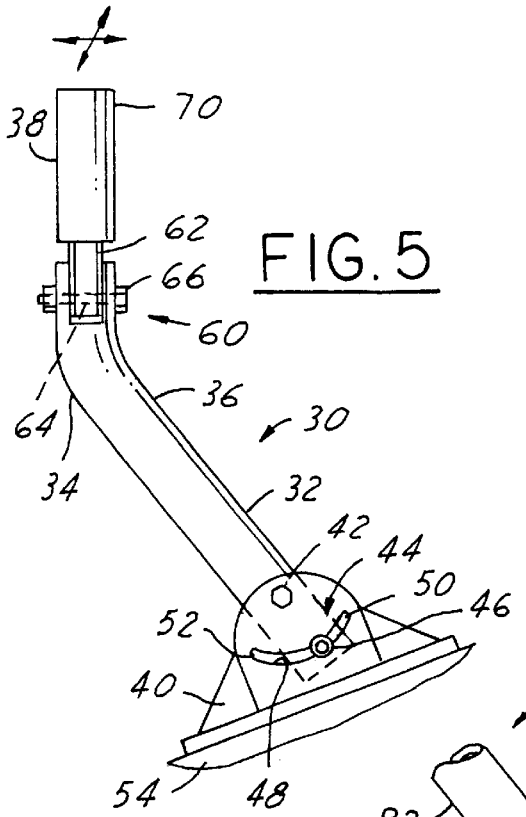
FIG. 5 is a side of the antenna mast of FIG. 2 mounted on an uneven surface.
Figure 6:
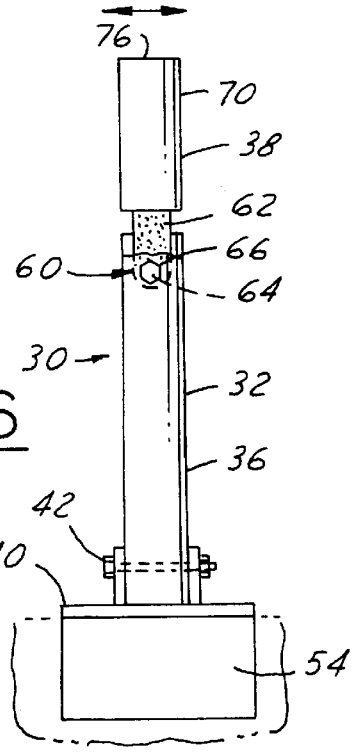
FIG. 6 is a rear view of the antenna mast of FIG. 2 mounted on an uneven surface.

Referring now to FIGS. 5 and 6, which illustrate the antenna mast 30 of FIGS. 2 through 4. As shown in FIG. 5, the base portion 40 is mounted at an angle with respect to the y-axis. This typically occurs when a user does not have a flat location on their roof or other structure to mount the antenna. Accordingly, the antenna mast is mounted such that the base portion 40 is angled or inclined. Thus, to adjust the antenna mast 30 in the y-direction, the lower portion 36 is rotated about the pivoting fixation device 42 and the travel mechanism 46 is slid in the recessed channel 48 until the lower portion 36 is straight. Thereafter, the pivoting fixation device 42 is retightened. The adjustment process is preferably accomplished manually, however, it could also be done electronically based on certain inputs.

As shown in FIG. 6, once the lower portion 36 has been adjusted in the y-direction the upper portion 38 can be adjusted in the x-direction. This is accomplished by rotating the upper portion 38 about the rotatable securing device 66 until the uppermost portion 70 is perfectly straight. This can be monitored by visual inspection, by an integral bubble mechanism, a portable level or other similar device. Once the upper portion 38 is properly aligned, the rotatable securing device can be tightened and kept in place by the friction material 72.

Figure 7:
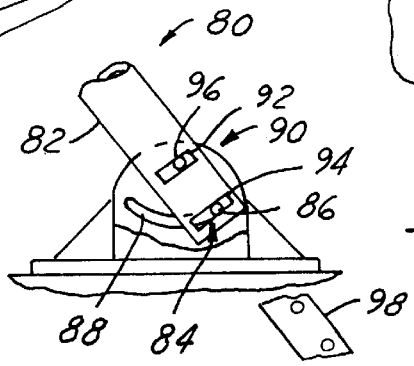
FIG. 7 is a side view of another embodiment of an antenna mast in accordance with the present invention.

Turning now to FIG. 7, which illustrates another embodiment of an antenna mast 80 in accordance with the present invention. As shown, the antenna mast 80 has a single unitary tube 82. The mast 80 has a first adjustment mechanism 84, including a travel mechanism 86 and a recess channel 88. The first adjustment mechanism 84 operates to adjust the mast 80 in the y-direction in the same manner as the first adjustment mechanism 44, as discussed above.

The antenna mast 80 also has a second adjustment mechanism 90. The second adjustment mechanism 90, in the embodiment of FIG. 7, is comprised of a pair of slots 92, 94 formed in either side of the tube 82 adjacent the travel mechanism 86 and a pivoting fixation device 96. In order to adjust the alignment of the antenna mast 80 in the x-direction, the antenna mast 80 need only be rotated such that the pair of slots 92, 94 move with respect to the travel mechanism 86 and the pivoting fixation device 96. Additionally, the tube 82 can be fitted with an inner section 98 that is telescopically received within the tube 82. The inner section 98 may be utilized to center the travel mechanism 86 and the pivoting fixation device 96 through the pair of slots 92, 94 and to add additional strength to the tube 82.

Figure 8:
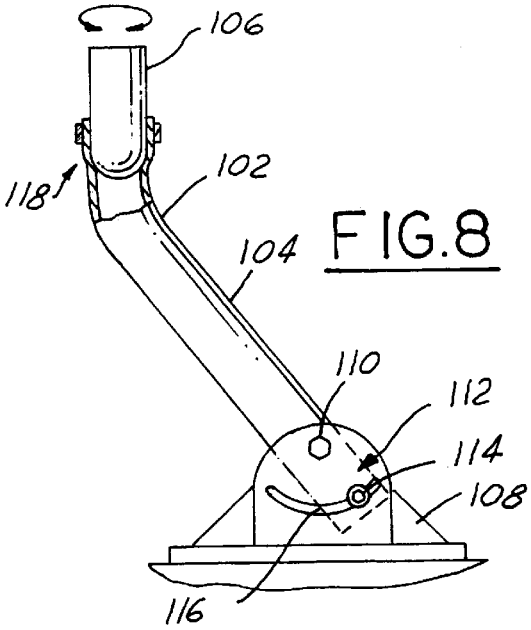
FIG. 8 is a side view of still another embodiment of an antenna mast in accordance with the present invention.
Figure 9:
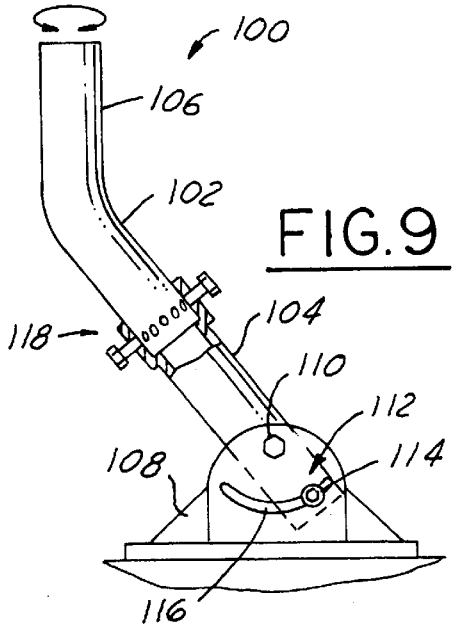
FIG. 9 is a side view of yet another embodiment of an antenna mast in accordance with the present invention.

FIGS. 8 and 9 illustrate another embodiment of an antenna mast in accordance with the present invention. The antenna mast 100 has a circular tube 102 that is segregated into a lower portion 104 and an upper portion 106. The lower portion 104 of the antenna mast 100 is attached to a base portion 108 by a pivoting fixation device 110. Similar to the embodiment disclosed in FIGS. 2 through 4, the base portion 108 includes a first adjustment mechanism 112, including a travel mechanism 114 and a recessed channel 116. The first adjustment mechanism 112 allows the antenna mast 100 to move with respect to the base portion 108 allowing for adjustment of the perpendicularity of the antenna mast 100.

The antenna mast 100 also includes a second adjustment mechanism 118 that is located at the connection between the lower portion 104 and the upper portion 106. In the embodiment shown in FIG. 8, the lower portion 104 is attached to the upper portion 106 by a ball joint 120 having clamp rotating action. The ball joint 120 allows the upper portion 106 to be rotated with respect to the lower portion 104 in order to adjust the x-direction of the mast 100. While a ball joint 120 is disclosed, a variety of other structures may be utilized.

As shown in FIG. 9, the upper portion 106 has a diameter that is smaller than the diameter of the lower portion 104 such that the upper portion 106 is telescopically received within the lower portion 104. In this embodiment, the second adjustment mechanism 90 is the rotation of the upper portion 106 with respect to the lower portion 104. The upper and lower portions 104, 106 are preferably secured to one another by a clamping joint with screws. It will be understood by one of skill in the art that a variety of other clamping or securing mechanisms may be utilized.

While a preferred embodiment of the present invention has been described so as to enable one skilled in the art to practice the present invention, it is to be understood that variations and modifications may be employed without departing from the purview and intent of the present invention, as defined in the following claims. Accordingly, the preceding description is intended to be exemplary and should not be used to limit the scope of the invention. The scope of the invention should be determined only by reference to the following claims.

What is claimed is:

1. An antenna mast for a multi-satellite system, comprising:

a base mounted at a lower end of the mast;

a first adjustment mechanism that allows the mast to be adjusted in a first direction, said first adjustment mechanism including a travel mechanism and a recessed channel cooperatively associated with said base, said travel mechanism operable to be interfit within said recessed channel; and a second adjustment mechanism that allows the mast to be adjusted in a second direction, where said second direction is perpendicular to said first direction.

2. The antenna mast of claim 1, further comprising:

a lower mast portion secured to said base; and an upper mast portion secured to said lower mast portion.

3. The antenna mast of claim 2, wherein said upper mast portion is rotatably attached to said lower mast portion.

4. The antenna mast of claim 3, wherein said upper mast portion is rotatably attached to said lower mast portion by a single through bolt.

5. The antenna mast of claim 3, further comprising:

a friction material in communication with said upper mast portion adjacent the attachment to said lower mast portion to prevent relative movement therebetween once said upper mast portion is secured to said lower mast portion.

6. The antenna mast of claim 3, wherein said upper mast portion is rotatably attached to said lower mast portion by a ball joint.

7. The antenna mast of claim 3, wherein said upper mast is received within said lower mast.

8. The antenna mast of claim 1, further comprising:

an integral bubble level to assist in aligning the mast.

9. The antenna mast of claim 1, wherein said second adjustment mechanism is at least one slot formed in the mast to allow adjustment of the mast in the first direction.

10. A multi-satellite antenna alignment system, comprising:

a base portion secured to a surface;

an antenna mast having a lower end that is pivotally secured to said base portion;

an antenna dish secured to said antenna mast at an upper end;

a first adjustment mechanism formed in said base portion that allows said antenna mast to be adjusted in a y-direction; and a second adjustment mechanism that allows said antenna mast to be adjusted in an x-direction.

11. The system of claim 10, wherein said antenna mast comprises an upper portion that is moveable with respect to said lower portion.

12. The system of claim 11, wherein said upper portion includes a flange portion that is telescopically received within said lower mast portion.

13. The system of claim 12, wherein said lower portion is rotatably secured to said flange portion allowing said antenna mast to be adjusted in an x-direction.

14. The system of claim 13, wherein said flange portion has a friction material on at least a portion thereof.

15. The system of claim 10, wherein said second adjustment mechanism includes at least one slot formed in said antenna mast to allow adjustment of the mast in the y-direction.

16. The system of claim 10, further comprising:

a bubble level integrally formed in said antenna mast to assist in its alignment.

17. A method of aligning a multi-satellite system, comprising:

securing an antenna base to a surface;

adjusting an antenna mast about a y-direction by pivoting it with respect to a base;

adjusting said antenna mast about an x-direction such that an uppermost portion of said mast is perpendicular with respect to ground.

18. The method of claim 17, further comprising:

forming at least one slot in said antenna mast and adjusting said antenna mast about said antenna mast by rotating said antenna mast about said at least one slot.

19. The method of claim 17, wherein said antenna mast has an upper portion and a lower portion and wherein said antenna mast is adjusted about an x-direction by pivoting said upper portion with respect to said lower portion.

20. The method of claim 17, wherein said antenna mast has an upper portion and a lower portion and wherein said antenna mast is adjusted about an x-direction by rotating said upper portion with respect to said lower portion.

* * * * *